United States Patent [19]

Caruel

[11] Patent Number: 4,802,337

[45] Date of Patent: Feb. 7, 1989

[54] FLAMEHOLDER FOR A TURBOJET ENGINE AFTERBURNER

[75] Inventor: Jacques E. J. Caruel, Maincy, France

[73] Assignee: Societe Nationale d-Etude et de Construction de Moteurs d-Aviation (SNECMA), Paris, France

[21] Appl. No.: 19,929

[22] Filed: Feb. 27, 1987

[30] Foreign Application Priority Data

Feb. 27, 1986 [FR] France ..... 86 02699

[51] Int. Cl.[4] ..... F02K 3/10

[52] U.S. Cl. ..... 60/749; 60/261

[58] Field of Search ..... 60/261, 749, 734, 752

[56] References Cited

U.S. PATENT DOCUMENTS

| | | | |
|---|---|---|---|
| 2,935,847 | 5/1960 | Markowski . | |
| 3,056,261 | 10/1962 | Krabacher et al. | 60/261 |
| 3,153,324 | 10/1964 | Meyer | 60/261 |
| 3,154,920 | 11/1964 | Nash et al. | 60/749 |
| 3,176,465 | 4/1965 | Colley, Jr. | 60/749 |
| 3,931,707 | 1/1976 | Vdoviak . | |
| 4,064,691 | 12/1977 | Nash | 60/261 |
| 4,259,839 | 4/1981 | Bayle-Laboure et al. | 60/261 |
| 4,418,531 | 12/1983 | Beal | 60/261 |
| 4,445,339 | 5/1984 | Davis, Jr. et al. . | |
| 4,490,973 | 1/1985 | Kinsey | 60/261 |

FOREIGN PATENT DOCUMENTS 706698 4/1954 United Kingdom .

*Primary Examiner*—Donald E. Stout
*Attorney, Agent, or Firm*—Bacon & Thomas

[57] ABSTRACT

A flameholder structure for a turbojet engine afterburner is disclosed in which a generally "V" shaped flameholder ring has a plurality of substantially radially extending fins attached to and extending radially outwardly from its outer surface. A portion of each of the fins is disposed at an angle to the gas flow so as to impart a cylindrical rotation to that portion of the flow passing over the fins. The cylindrical rotation of the flow increases the shear effect to thereby improve the stability of the flame front and increase the efficiency of the afterburner.

6 Claims, 1 Drawing Sheet

FLAMEHOLDER FOR A TURBOJET ENGINE AFTERBURNER

BACKGROUND OF THE INVENTION

It is well known to provide afterburner systems on turbojet engines and such systems typically comprises means to inject fuel into the gas stream mixture, downstream of the turbojet engine turbine and means to ignite the mixture. In turbofan engines, the afterburner system is usually located downstream of the point at which the hot flow of gases and the radially outer colder flow converge. By igniting the additional fuel and the exhaust gas stream, additional thrust is provided to the engine.

Although the afterburner theory is relatively simple, it has proven most difficult to achieve a complete burning of the fuel and to provide a stable flame front for the ignition of the gases. Various attempts have been made to increase the efficieny of the afterburner systems. The patent to Vdoviak (U.S. Pat. No. 3,931,707) illustrates one such attempt. The structure set forth in this patent utilizes an annular passage upstream of a generally "V" shaped flameholder ring to induce a circumferential swirl by a plurality of flow vanes disposed in this annular passage. However, this structure increases the complexity of the afterburner system thereby not only increasing the overall weight of the turbojet engine, but also increasing its maintenance and decreasing the overall reliability.

SUMMARY OF THE INVENTION

The present invention relates to a flameholder having a simplified construction to improve the overall efficiency of afterburner performance, without increasing the complexity of the engine structure. The flameholder according to the invention comprises an annular flameholder ring having a substantially "V" shaped cross-section attached in the afterburner duct of a turbojet engine. A plurality of substantially radially extending fins are attached to and extend radially outwardly from only a radially outer leg portion of the flameholder ring. The fins impart a cylindrical swirling flow to the portion of gas flowing over their surfaces.

The rotation produced by this flow segment generates a radial pressure gradient which serves to increase the recirculating zone downstream of the flameholder. Increasing the recirculation volume directly improves the stability range of the afterburner system.

The recirculation phenomenon also induces shearing turbulence near the boundary between the rotary cylindrical flow and the main flow outside of the flameholder which is not subject to this rotation. Accordingly, the flame propagation rate is increased to thereby achieve higher operational efficiency.

The present invention also enables the efficiency to be increased through a shorter longitudinal distance downstream from the flameholder. Thus, not only is the performance of the afterburner improved, the length of the turbojet engine duct may be made shorter, resulting in a sifnificant reduction in both the mass and bulk of the turbojet engine.

According to the invention, each of the radial fins has an upstream portion which extends in an upstream direction from the base of the annular flameholder ring in a direction generally parallel to the direction of the gas flow. A downstream portion of each of the fins extends at an angle to the direction of the gas flow so as to impart the circumferential motion to this portion of the gas flow.

The structure according to the invention avoids the teachings of the known prior art which utilize fins extending from a radially inwardly portion of the flameholder ring. The prior art generates a radially inner rotation in the gas flow which hinders the recirculation downstream of the flameholder due to the centrifugal speed component imparted by the fins. By utilizing only fins extending in a radially outwardly direction, this drawback of the prior art is avoided.

The invention also encompasses a substantially cylindrical sleeve which interconnects the radially outermost edges of each of the fins. A flange extends from the cylindrical sleeve in an upstream direction beyond the distal edge of each of the flanges.

DETAILED DESCRIPTION OF THE PREFERRED EMBODIMENT

Figure 1:
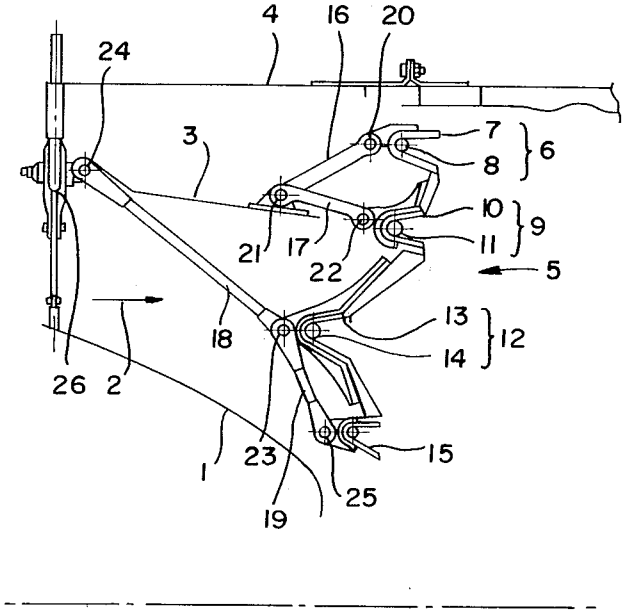
FIG. 1 is a partial, schematic diagram of a section of a rear portion of a turbojet engine having an afterburner utilizing a flameholder according to the invention.

A partial, sectional view of a turbojet engine with an afterburner is schematically shown in FIG. 1. The hot gas flow is defined internally by inner cowl 1 and externally by wall 3. The gases pass in the direction of arrow 2 from an upstream portion toward a downstream portion (to the right as seen in FIG. 1). Wall 3 separates this hot flow of gases from an outer, secondary flow, generally designated the cold flow, which circulates in the annular secondary duct between wall 3 and an outer wall 4. Although only an upper portion of the cross-section is shown, it is to be understood that all of these structures are symmetrical about the longitudinal axis of the engine and afterburner duct shown in FIG. 1.

The afterburner structure 5 is also shown in FIG. 1 interposed between the inner cowl 1 nd the outer duct 4, and comprises a radially outer burner ring 6 consisting of flameholder 7 and a fuel injection manifold 8. The radially outer burner ring 6 is located near the outer wall 4 in the cold flow. Burner ring 9 also consists of a flameholder 10 and fuel injection manifold 11 and is located near the convergence of the hot and cold flows. Another burner ring 12, also consisting of a flameholder ring 13 and a fuel injection manifold 14 is located in the stream of the hot gases, as is radially innermost flameholder ring 15.

The various rings are attached to the fixed wall 3 separating the hot and cold flows by means of link rods 16, 17, 18 and 19, provided at their ends with hinge attachment means 20, 21, 22, 23, 24 and 25. The system also includes a fuel intake device 26 located upstream of the afterburner structure. Although one or more of the burner rings may include a flameholder according to the present invention, the most advantageous application of the invention is to incorporate the radial fins in the flameholder 10 at the juncture of the hot and cold flows.

Figure 2:
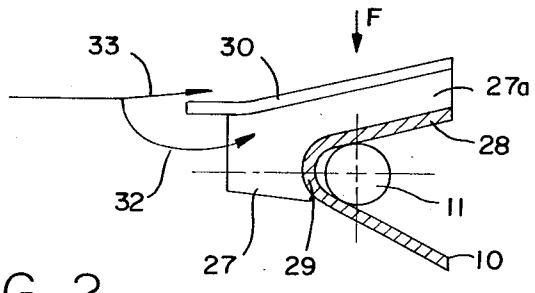
FIG. 2 is a partial, cross-sectional view of the flameholder structure according to the invention.
Figure 3:
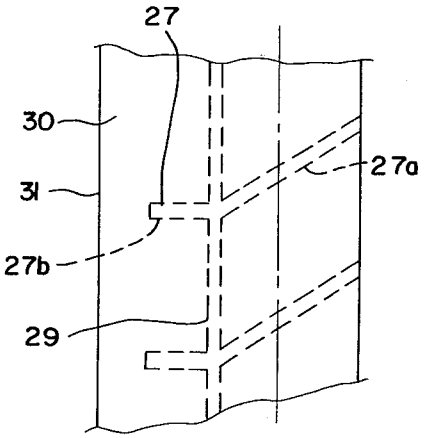
FIG. 3 is a partial, top view taken in the direction of arrow F in FIG. 2.

The specific design according to the invention is shown in detail in FIGS. 2 and 3. A plurality of substantially radially extending fins 27 are mounted on, and extending radially outwardly from, the radially outer leg portion 28 of flameholder 10. As can be seen from FIG. 2, the flameholder 10 has a generally "V" shaped cross-section and is oriented such that the "V" opens in a downstream direction. The "V" shaped cross-section is defined by a radially outer leg portion 28, and a radially inner leg portion interconnected at their upstream edges by base portion 29, which may be curved as shown.

Each of the fins 27 comprise a downstream portion 27a which extends at an angle to the direction of the gas flow so as to impart a circumferential component to the motion of such flow. Each fin 27 also has a portion 27b extending from the base portion 29 of the flameholder 10 in an upstream direction generally parallel to the direction of gas flow. The fins 27 are regularly distributed about the periphery of flameholder 10 to ensure that the cylindrical portion of the gas flow passing over the fins is set into rotation.

The radially outermost edges of fins 27 may be connected by a continuous, generally cylindrical sleeve 30. Flange 31 may be formed on the upstream edge of outer sleeve 30 such that a distal edge of this flange extends, in an upstream direction, beyond the upstream edges of fins 27. This arrangement enhances the separation of the flow designated by arrows 32 and 33 in FIG. 2, such that the flow passing in a direction of arrow 32 is set into rotation due to its passage over the fins 27, while the flow denoted by arrow 33 is not given such a motion. This increases the shearing effect of the mixture.

The foregoing description is provided for illustrative purposes only and should not be construed as in any way limiting this invention, the scope of which is defined solely by the appended claims.

What is claimed is:

1. A flameholder structure for a turbojet engine afterburner having an afterburner duct to direct turbojet engine gases from an upstream portion toward a downstream portion, the flameholder structure comprising:

(a) an annular flameholder ring having a substantially "V"-shaped cross-section defined by a radially outer leg portion and a radially inner leg portion interconnected at upstream ends by a base portion such that the "V" shape opens in a downstream direction; and (b) a plurality of substantially radially extending fins regularly distributed about the periphery of the annular flameholder ring and extending radially outwardly therefrom into the turbojet engine gas flow from only the radially outer leg portion of the flameholder ring, each fin having at least a downstream portion attached to the radially outer leg portion and in contact therewith along substantially its entire length, each downstream portion disposed at an angle to the direction of the gas flow so as to impart a circumferential rotation to that portion of the gas flow passing across the fins.

2. The flameholder structure according to claim 1 wherein each of the fins has a portion extending from the base portion in an upstream direction substantially parallel to the direction of gas flow.

3. The flameholder structure according to claim 2 further comprising a generally cylindrical continuous sleeve interconnecting radially outermost edges of the plurality of fins.

4. The flameholder structure according to claim 3 further comprising a flange formed on the cylindrical sleeve and extending therefrom in an upstream direction such that a distal edge of the flange extends beyond upstream edges of the fins.

5. The flameholder structure according to claim 1 further comprising a generally cylindrical continuous sleeve interconnecting radially outermost edges of the plurality of fins.

6. The flameholder structure according to claim 5 further comprising a flange formed on the cylindrical sleeve and extending therefrom in an upstream direction such that a distal edge of the flange extends beyond upstream edges of the fins.

* * * * *

UNITED STATES PATENT AND TRADEMARK OFFICE

CERTIFICATE OF CORRECTION

PATENT NO. : 4,802,337

DATED : February 7, 1989

INVENTOR(S) : Jacques E. J. CARUEL

It is certified that error appears in the above-identified patent and that said Letters Patent is hereby corrected as shown below:

Col. 1, line 20, "efficieny" should be --efficiency--.

Col. 1, line 61, "sifnificant" should be --significant--.

Col. 2, line 44, "nd" should be --and--.

Signed and Sealed this

Eighteenth Day of July, 1989

*Attest:*

DONALD J. QUIGG

*Attesting Officer*

*Commissioner of Patents and Trademarks*